United States Patent [19]

Kuwano et al.

[11] Patent Number: 4,648,580

[45] Date of Patent: Mar. 10, 1987

[54] DIRECT-DRIVE TYPE ELECTRO-HYDRAULIC SERVO VALVE

[75] Inventors: Hiroaki Kuwano, Yokohama; Toshiro Matsushita, Yokosuka; Hideaki Kakuma, Atsugi; Teruaki Motomiya, Sagamihara, all of Japan

[73] Assignee: Ishikawajima-Harima Jukogyo Kabushiki Kaisha, Tokyo, Japan

[21] Appl. No.: 842,079

[22] Filed: Mar. 20, 1986

Related U.S. Application Data

[63] Continuation of Ser. No. 601,593, Apr. 18, 1984, abandoned.

[30] Foreign Application Priority Data

Apr. 19, 1983 [JP] Japan ..... 58-68997

[51] Int. Cl.[4] ..... F15B 13/044

[52] U.S. Cl. ..... 251/129.01; 137/625.65; 251/129.04

[58] Field of Search ..... 137/625.65; 251/129.01, 251/129.04, 129.05, 129.08

[56] References Cited

FOREIGN PATENT DOCUMENTS 17006 1/1984 Japan ..... 137/625.65

*Primary Examiner*—Gerald A. Michalsky

[57] ABSTRACT

Disclosed is a direct-drive type electro-hydraulic servo valve in which dynamic characteristics of a spool are simulated by an electronic circuit or a computor to derive a signal representative of the spool velocity and the derived signal is negatively fed back to an input of a power amplifier.

4 Claims, 8 Drawing Figures

DIRECT-DRIVE TYPE ELECTRO-HYDRAULIC SERVO VALVE

This application is a continuation of application Ser. No. 601,593, filed Apr. 18, 1984, now abandoned.

BACKGROUND OF THE INVENTION

The present invention relates to a direct-drive type electro-hydraulic servo valve of the type in which a spool is directly driven by a moving coil mounted on the spool and a stationary permanent magnet on the valve body.

Referring first to FIG. 1, a prior art direct-drive type electro-hydraulic servo valve will be described.

A sleeve 2 is fitted into a valve body 1 and a spool 3 is slidably fitted into the sleeve 2. A bobbin 4 upon which a coil 5 is mounted is securely attached to one end of the spool 3. A permanent magnet 6 is mounted on the valve body 1 so that a magnetic circuit is established between the coil 5 and the permanent magnet 6. When the coil 5 is energized, the spool 3 is caused to slide so that a desired intercommunication among oil passages 7, 8 and 9 within the valve body 1 can be established.

A displacement sensor 10 for sensing or detecting the position of the spool 3 is disposed at the other end of the spool 3 so as to determine the position of the spool 3 with respect to the sleeve 2. The output signal from the displacement sensor 10 is negatively fed back to the input of a power amplifier and is compared with a set point (not shown), thereby providing a feedback control system for stabilizing the spool 3.

Next the displacement of the spool is investigated. When the coil 5 is energized, the magnetic field is generated which interacts with the magnetic field of the permanent magnet 6. As a result, in response to the amperage and direction of the current, the spool 3 is displaced. Because of the above-described negative feedback from the displacement sensor 10, the spool 3 is stopped at a predetermined position and a liquid in quantity in proportion to the set point (not shown) can be supplied to a desired place.

However, when the spool 3 is driven or displaced in the manner described above, the spool 3 is oscillated as shown in FIG. 2*a*. Since the spool 3 is immersed entirely into a working oil filled within the sleeve 2, no damping action or brake is exerted to the spool 3 which is being displaced. Oscillation or vibration of the spool 3 causes oscillation or vibration of an actuator which is driven by the servo valve. Thus there exists a serious control problem.

There has been devised and demonstrated a method for decreasing response of a servo valve in order to prevent oscillation or vibration of the spool 3 (See FIG. 2*b*), but the high responsiveness of direct-drive type electro-hydraulic servo valves is thereby degraded.

Therefore a velocity sensor 11 is mounted on the spool 3 at the side of the bobbin 4 so as to sense or detect the velocity of the spool 3. The output of the velocity sensor 11 is negatively fed back to the power amplifier so that the spool 3 is damped.

Referring next to FIG. 3, the damping control will be described in detail.

R is a set point (opening or closing degree instruction) for the displacement of the spool 3 and is derived as an instruction from a servo-valve control system. $K_A$ is an electrical gain which is so controlled as to determine the response of the servo valve $K_X$ is an electrical gain of the displacement sensor 10 and remains unchanged once set. $K_B$ is a coefficient of a counter electromotive force produced when the coil 5 moves within the magnetic field of the permanent magnet 6. $K_F$ is a coefficient of a force exerted on the coil 5 when a current i is produced. $K_Q$ is a coefficient of the output flow rate Q which is dependent upon specfications of the servo valve. T is a time constant of the coil 5; m, the mass of the spool 3; b, a coefficient of the viscous damping exerted on the spool 3; F, the driving force for displacing the spool 3; v, the velocity of the spool 3; and s, a Laplace operator.

The damping force exerted on the spool 3 is dependent upon the viscous damping coefficient b and the coefficient of the counter electromotive force $K_B$; but such damping force is in general insufficient. Therefore in response to the velocity v detected by the velocity sensor 11, the damping force is multiplied with a suitable gain $K_V$ and negatively fed back.

Assume that the response of the coil 5 is fast enough (that is, the time constant T is almost zero), the loop gain from a signal V to a signal F becomes the product $K_V$. $K_F$. It is apparent therefore that it has the same dimension as the viscous damping coefficient b. That is, by effectng the negative feedback of v and by controlling suitably the value of $K_V$, the damping force can be applied to the spool 3. In practical usage, the effectiveness of the velocity feedback is influenced by the time constant T of the coil, but only slightly.

However, in the servo valve of the type described above, the velocity sensor 11 which is needed to control the damping is incorporated in a very limited space in the servo valve which is a precision device. As a result, the assembly is difficult, the cost is increased and the number of component parts of the velocity sensor is also increased. Therefore reliability is degraded. In addition, there arises a problem that if the velocity sensor is damaged, the whole servo valve must be replaced with a new one.

The present invention was made to overcome the above and other problems encountered in the prior art and has as its object to provide a direct-drive type electro-hydraulic servo valve in which damping can be exerted on a servo valve without providing a velocity sensor in the main body of the servo valve.

The above and other objects, effects, features and advantages of the present invention will become more apparent from the following description of a preferred embodiment thereof taken in conjunction with the accompanying drawings, same reference numerals being used to designate similar parts throughout the figures.

DETAILED DESCRIPTION OF THE PREFERRED EMBODIMENTS

Figure 1:
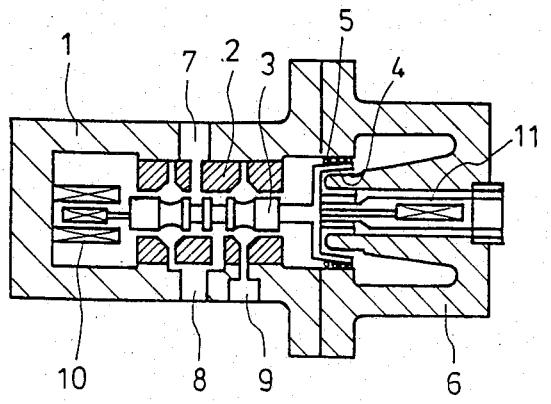
Fig. 1 PRIOR ART
FIG. 1 is a cross sectional view of a conventional servo valve.
Figure 2A:
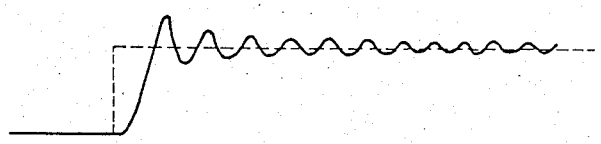
FIGS. 2*a* and 2*b* show the movements of a spool when damping is not sufficient.
Figure 2B:
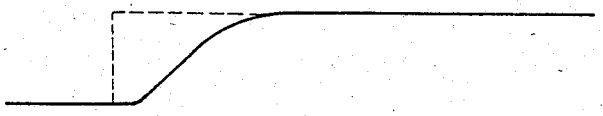
Figure 4:
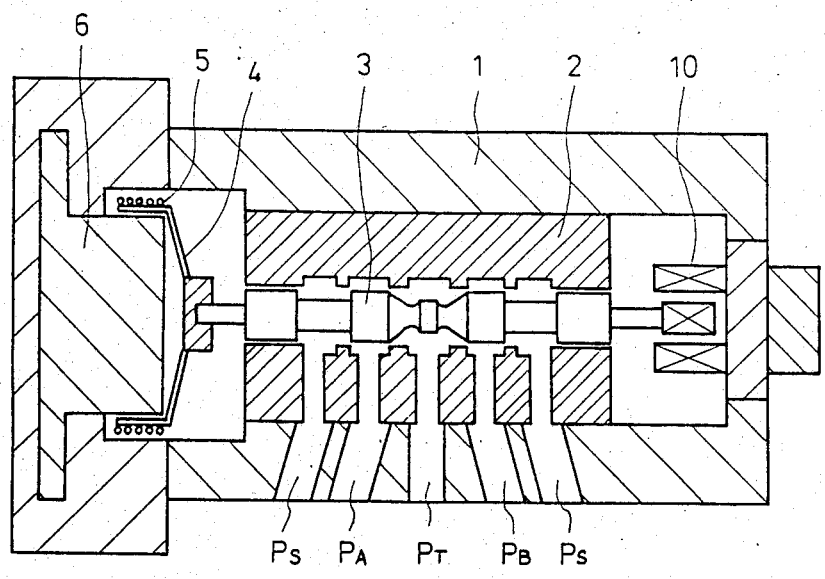
FIG. 4 is a longitudinal sectional view of a preferred embodiment of a servo valve in accordance with the present invention.

FIG. 4 is a sectional view of a preferred embodiment of a direct-drive type electro-hydraulic servo valve in accordance with the present invention. Since the mechanical construction of the servo valve in accordance with the present invention is substantially similar to that of the conventional servo valve as shown in FIG. 1, no detailed parts are shown.

In FIG. 4, $P_T$ designates a tank port; $P_S$; a supply pressure port; and $P_A$ and $P_B$, load ports.

No velocity sensor is incorporated in the servo valve shown in FIG. 4 and the velocity of the spool 3 is electrically detected.

Figure 5:
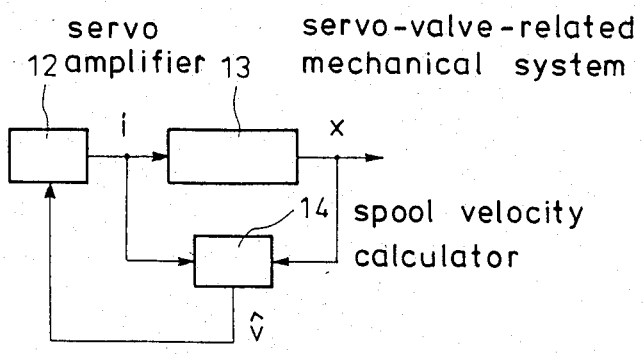
FIG. 5 is a block diagram thereof used to explain the underlying principle of the present invention.
Figure 6:
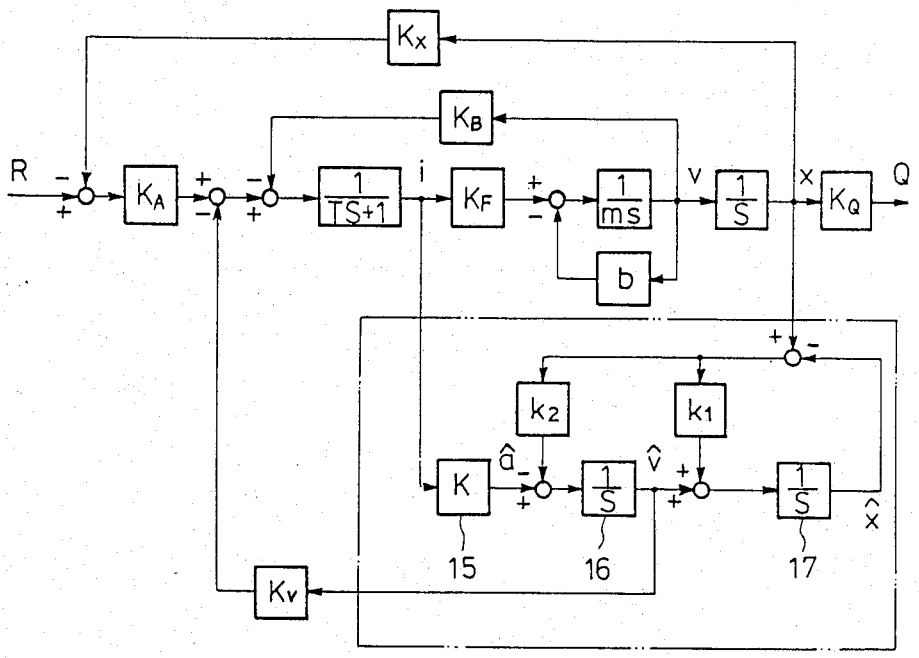
FIG. 6 is a block diagram thereof.

Referring next to FIGS. 5 and 6, the detection of the velocity of the spool will be described.

FIG. 5 is a block diagram of the servo valve in accordance with the present invention in which reference numeral 12 designates a servo amplifier; 13, a servo-valve-related mechanical system (spool characteristics); and 14, a spool velocity calculator (a model of the spool characteristics).

Figure 3:
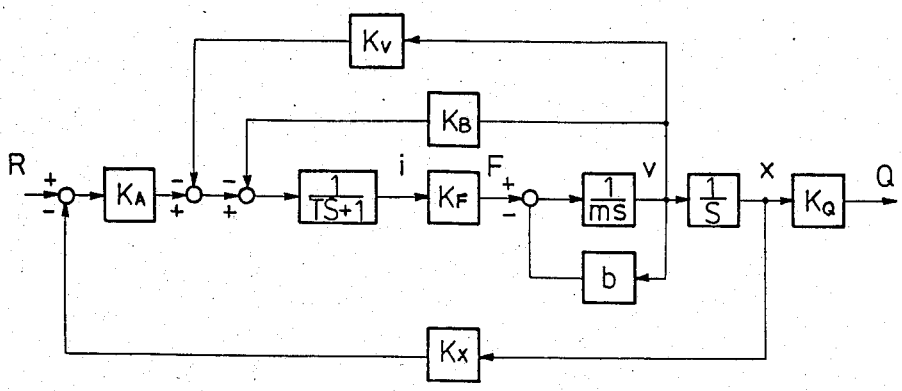
FIG. 3 is a block diagram when damping control is effected by means of a velocity detector.

The spool velocity calculator 14 receives the input current i to coil 5 of the servo valve and the displacement x of the spool 3. In response to these data, the estimated velocity $\hat{v}$ of the spool 3 is calculated. The estimated velocity signal $\hat{v}$ is negatively fed back to the servo amplifier 12 so that as described with reference to FIG. 3, the damping of the spool 3 can be effected.

The mode of operation will be described in more detail with reference to FIG. 6.

In FIG. 6, K represents $K_F/m$ of the servo valve; $k_1$ and $k_2$; $\hat{v}$, an estimated velocity signal representative of an estimated velocity of the spool 3; $\hat{a}$, a signal representative of an estimated acceleration of the spool 3; and $\hat{x}$, a signal representative of an estimated displacement of the spool 3. In FIG. 6, the block indicated by the two-dot chain lines represents the velocity calculator (a model of the spool characteristics).

The current i flowing into the coil 3 is multiplied by the coefficient K 15 so that the driving force exerted on the spool 3 and then the estimated acceleration signal $\hat{a}$ are obtained. The estimated acceleration signal $\hat{a}$ is sequentially integrated by integrators 16 and 17 so that the estimated velocity signal $\hat{v}$ and the estimated displacement signal x are obtained.

The estimated displacement signal $\hat{x}$ is compared with the actual displacement x of the spool 3 and the difference is multiplied by the gains $k_1$ and $k_2$ and the products thus obtained are fed back to $\hat{v}$ and $\hat{a}$. As a result, the estimated acceleration signal $\hat{a}$ and the estimated velocity signal $\hat{v}$ are simultaneously adjusted such that the difference between the actual displacement x and the estimated displacement signal $\hat{x}$ of the spool 3 becomes zero. Therefore the correct estimated velocity signal $\hat{v}$ of the spool 3 can be always obtained.

As described above, according to the present invention, no velocity detector is incorporated into a limited narrow space in a servo motor, but the actual spool velocity can be always obtained from time to time by a simple circuit disposed outside of a servo valve body.

Figure 7:
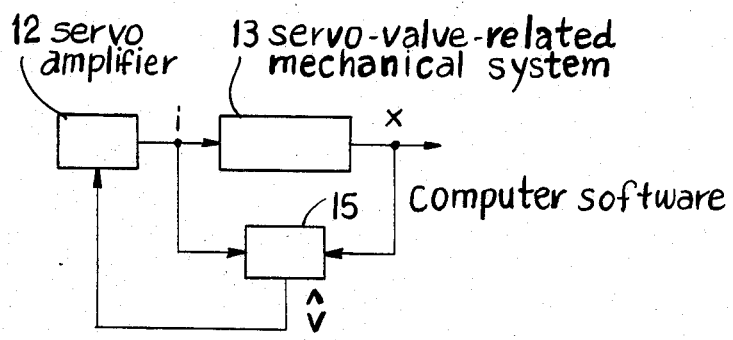
FIG. 7 is a block diagram of an alternative embodiment.

So far the electronic circuit has been described, but it is to be understood that the present invention may use software 15 of a computer (FIG. 7). Furthermore, the preferred embodiment has been described as having the power amplifier of controlling voltage type, but it is to be understood that a current-control type amplifier in which the current i is negatively fed back in a minor loop can be used. In the latter case, the influences of the time constant T of the coil and the transmission voltage coefficient $K_B$ are eliminated so that the damping efficiency is further improved.

As described above, according to the present invention, no velocity detector is incorporated in a servo valve, but the servo valve can be damped. As a result, the fabrication cost can be reduced while reliability can be remarkably improved. Furthermore the present invention can provide a servo valve which has fast and stable response characteristics.

What is claimed is:

1. A direct drive electro-hydraulic servo valve comprising a valve body accommodating a spool, a coil mechanically connected to the spool and electrically connected to a servo amplifier and a permanent magnet mounted on the valve body, said spool being directly driven by energization of the coil by the amplifier, the valve also including simulating means located outside of the valve body for simulating characteristics of the spool connected to the amplifier, said simulating means being arranged to functionally relate a signal representative of spool position with a signal representative of current input to the coil to derive a signal representative of spool velocity which is thereby generated entirely within said simulating device and is then negatively fed back to the amplifier.

2. A servo valve according to claim 1, wherein said simulating means simulate signals of acceleration, velocity, and displacement which represent the actual movement of the spool.

3. A servo valve according to claim 1, wherein said simulating means is an electronic circuit.

4. A servo valve according to claim 1, wherein the simulating means is an appropriately programmed computer.

* * * * *

UNITED STATES PATENT AND TRADEMARK OFFICE

CERTIFICATE OF CORRECTION

PATENT NO. : 4,648,580

DATED : March 10, 1987

INVENTOR(S) : Hiroaki Kuwano et al

It is certified that error appears in the above-identified patent and that said Letters Patent are hereby corrected as shown below:

Title Page, item [73] should read as follows:

[73] Assignee: Ishikawajima-Harima Jukogyo Kabushiki Kaisha, Tokyo, Japan; and Kabushiki Kaisha Akashi Seisakusho, Tokyo, Japan

Signed and Sealed this

Twenty-fifth Day of August, 1987

*Attest:*

*Attesting Officer*

DONALD J. QUIGG

*Commissioner of Patents and Trademarks*